US005180054A

United States Patent [19]

Bakx

[11] Patent Number: 5,180,054

[45] Date of Patent: Jan. 19, 1993

[54] WRAP-AROUND CARTON WITH END CLOSURE PANELS

[75] Inventor: Martinus C. M. Bakx, Roosendaal, Netherlands

[73] Assignee: The Mead Corporation, Dayton, Ohio

[21] Appl. No.: 667,163

[22] Filed: Mar. 11, 1991

[30] Foreign Application Priority Data

Mar. 8, 1990 [GB] United Kingdom ..... 9005223

[51] Int. Cl.[5] ..... B65D 75/00

[52] U.S. Cl. ..... 206/140; 206/427; 206/434; 229/40

[58] Field of Search ..... 229/40; 206/140, 175, 206/427, 434, 439, 139

[56] References Cited

U.S. PATENT DOCUMENTS

| | | | |
|---|---|---|---|
| 2,594,376 | 4/1952 | Arneson . | |
| 2,832,182 | 4/1958 | McGihon | 206/434 |
| 2,849,111 | 8/1958 | Fielding . | |
| 2,943,427 | 7/1960 | Fisher | 206/434 |
| 3,167,214 | 1/1965 | Mahon | 229/40 |
| 3,252,649 | 5/1966 | Graser et al. | 206/140 |
| 3,963,121 | 6/1976 | Kipp | 206/434 |
| 4,029,204 | 6/1977 | Manizza | 206/434 |
| 4,029,207 | 6/1977 | Gordon | 206/427 |
| 4,216,861 | 8/1980 | Oliff | 229/40 |
| 4,440,340 | 4/1984 | Bakx | 229/40 |
| 4,925,019 | 5/1990 | Ganz et al. . | |
| 5,000,313 | 3/1991 | Oliff | 206/434 |
| 5,020,668 | 6/1991 | Schuster | 229/40 |
| 5,060,792 | 10/1991 | Oliff | 26/434 |

FOREIGN PATENT DOCUMENTS

| | | | |
|---|---|---|---|
| 8903792 | 5/1989 | PCT Int'l Appl. | 206/427 |
| 1040748 | 9/1966 | United Kingdom . | |
| 1580966 | 12/1980 | United Kingdom . | |
| 2209525 | 5/1989 | United Kingdom . | |

*Primary Examiner*—David T. Fidei
*Attorney, Agent, or Firm*—Erwin Doerr

[57] ABSTRACT

A carton of the wraparound type comprises top (18) and bottom panels (12, 24) connected together by spaced side wall panels (14, 16:20,22) forming a tubular structure has a set of end panels (S1,S2) at each end of the tubular structure at least partially to close the ends of the carton. Each set comprises a pair of lower end closure panels hinged to respective ones of the side wall panels which are folded towards one another to close a lower part of the end and an upper end panel hinged to the top panel of the carton. The upper end panel and each of the lower end closure panels are connected by a retaining panel which extends sufficiently internally of the tubular structure to permit it to be tucked between upper portions of the endmost articles and the respective side wall panels adjacent thereto so as to maintain the upper end panel and the lower end closure panels in position.

3 Claims, 2 Drawing Sheets

WRAP-AROUND CARTON WITH END CLOSURE PANELS

This invention relates to a carton for accommodating articles such as bottles, of the wraparound type which is provided with a set of end closure panels at each end of the carton which at least partially close the ends of the carton.

Each set of end closure panels comprise a pair of panels hinged to the side walls of the carton and which fold across an open end of the carton towards one another and a further panel hinged to a top wall of the carton which is folded inwardly of the carton or folded downwardly towards or to meet the said pair of folded panels.

U.S. Pat. No. 3,670,950 discloses a wraparound type carton for bottles having upper and lower end closure panels for closing the ends of the carton. The lower end panels are retained in the closed position by bottom locking panels and by the upper end closure panel.

U.S. Pat. No. 4,202,446 also discloses a wraparound type carton for bottles in which an upper end closure panel includes a locking tab which engages behind a pair of lower end closing panels.

FR-A-1 424 536 discloses a wraparound type carton for cans in which end closure panels are provided partially to close upper portions of the ends of the cartons and are connected to an internally disposed panel which overlies the tops of the endmost cans in the carton.

In the present invention lower end closure panels which are connected to an upper end closure panel at each end of the carton can be put into closing position by folding of the upper end closure panel by virtue of hinged connections between those panels. The end closure panels are maintained in their closing positions by retention means which are tucked between the endmost articles in the carton and the carton side walls adjacent thereto.

The invention provides a carton of the wraparound type for bottles which carton comprises top and bottom panels connected together by spaced side wall panels thereby forming a tubular structure and a set of end panels at each end of the tubular structure at least partially to close the ends of the carton each said set comprising a pair of lower end closure panels hinged to respective ones of the side wall panels which are folded across that end of the tubular structure towards one another to close a lower part of said end and an upper end panel hinged to the top panel of the carton said upper end panel and each of said lower end closure panels are connected by a retaining panel which extends sufficiently internally of the tubular structure to permit it to be tucked between upper portions of the endmost articles and the respective side wall panels adjacent thereto so as to maintain said upper end panel and said lower end closure panels in position.

According to a feature of the invention, each upper end panel may be folded downwardly from said top panel at least partially to complete the closure of that end of the carton associated with the said upper end panel.

According to another feature of the invention, each upper end panel may be folded inwardly of the tubular structure into superposed relationship with said top panel.

Preferably, said upper end closure panel and each of said lower end closure panels are connected by at least one gusset panel.

In some carton constructions according to the invention each of said lower end closure panels may be connected to a bottom panel by foldable gusset panels adapted to provide a two-ply element at each lower corner of said carton.

Embodiments of the invention will now be described, by way of example, with reference to the accompanying drawings in which.

Figure 1:
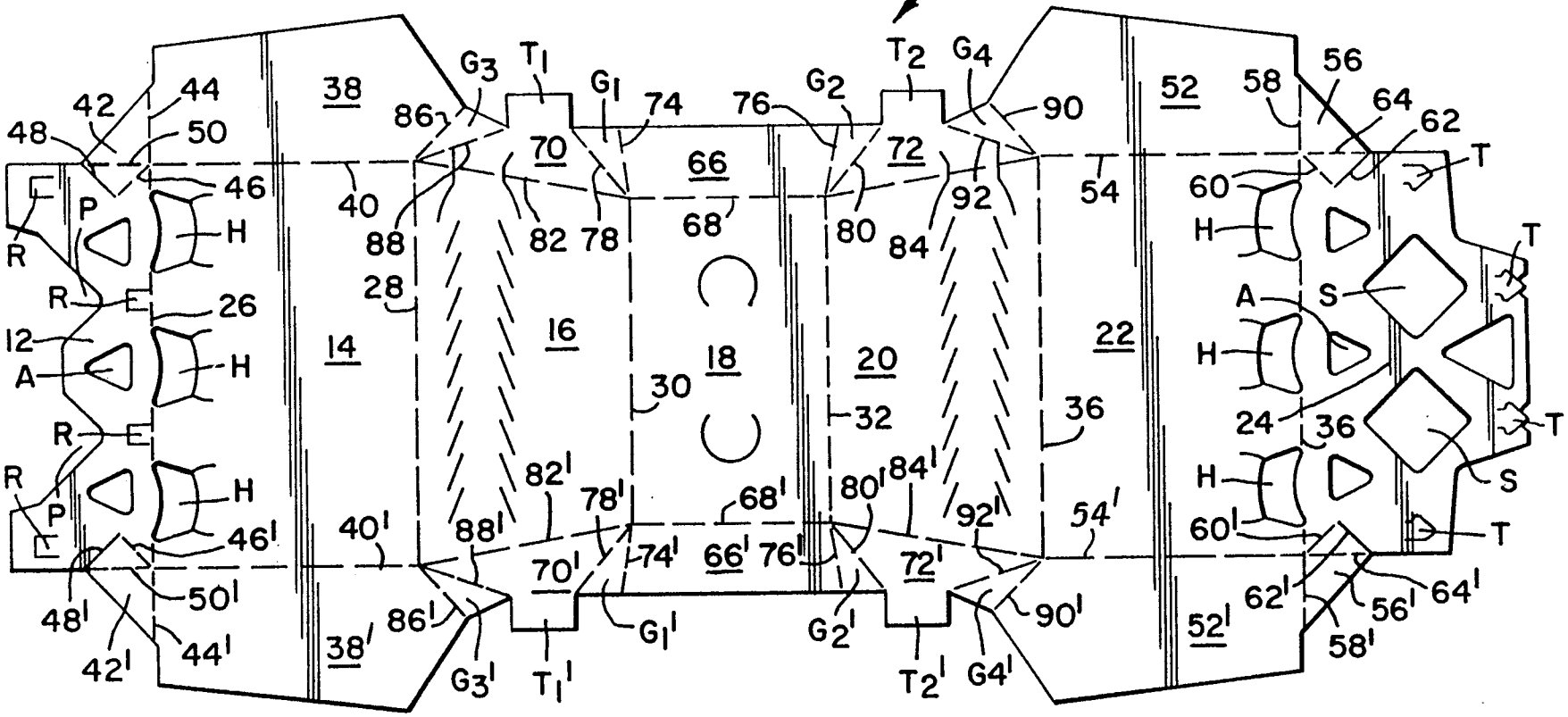
FIG. 1 is a plan view of a paperboard blank for forming a carton according to the invention.
Figure 2:
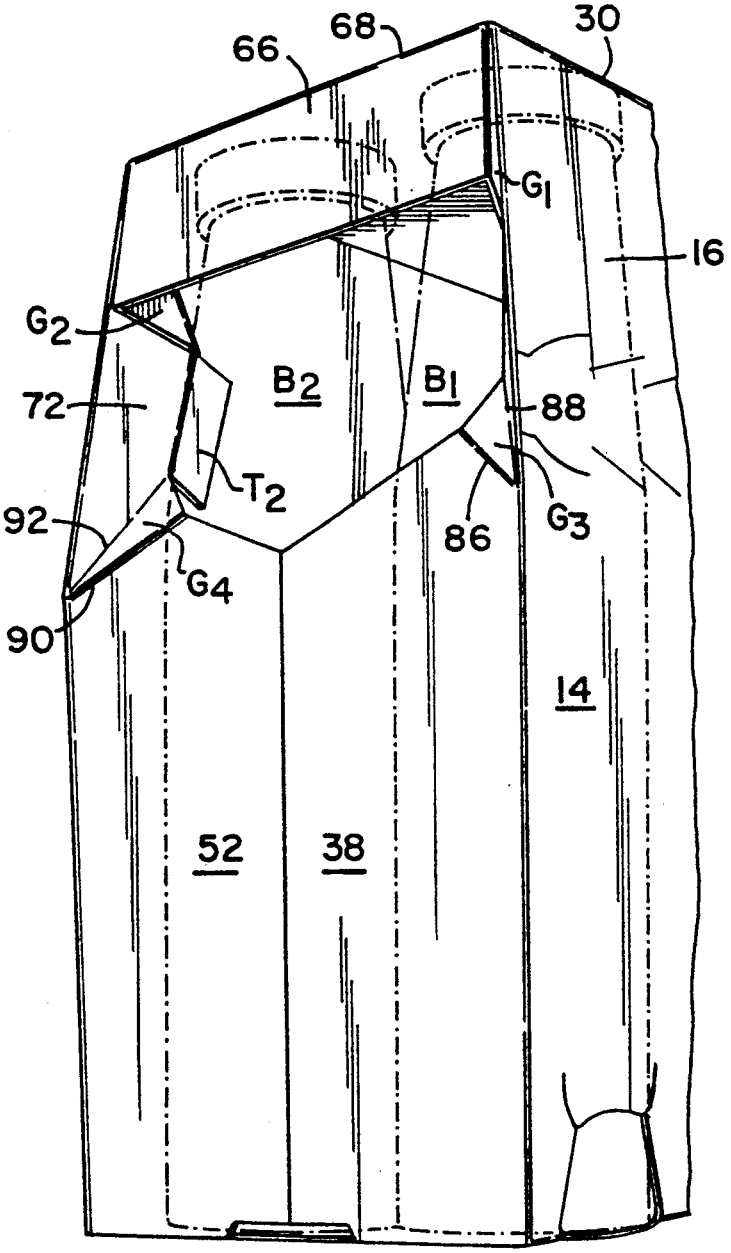
FIG. 2 is a perspective view of an end portion of the carton seen from below and showing a set of end closure panels in a closed position.

Referring to the drawings and first more particularly to FIGS. 1 and 2 thereof, there is shown an elongate blank 10 of paperboard or similar foldable sheet material. The blank comprises, in series, a first base panel 12, a first lower side wall panel 14, a first upper side wall panel 16, a top panel 18, a second upper side wall panel 20, a second lower side wall panel 22 and a second base panel 24, hinged one to the next along transverse fold lines 26–36. Base panel 24 is formed with a plurality of locking tabs "T" which co-operate with locking apertures defined by retaining tabs "R" formed at spaced locations in base panel 12 in order to lock the base panels together in overlapping relationship and thereby hold the blank in a tubular form.

Apertures "A" of deltoid shape are formed in both base panels and are utilised to draw the base panels together into overlapping relationship as is well known in the art. Square apertures "S" in base panel 24 and corresponding cut-away portions "P" in base panel 12 are provided so that the carton can be impaled upon a pair of upstanding posts provided in the base of a bottle crate.

Both the lower side wall panels 14 and 22 are formed with a series of bottle heel retaining apertures "H" which receive circumferential wall portions of the heel portion of bottles accommodated in the carton.

In order at least partially to close the ends of the carton when it is in its "wrap-around" form a set of end closure panels is formed along each of the longitudinal edges of the blank.

In one set of end closure panels, a lower side wall end closure panel 38 is hinged to first lower side wall panel 14 along a fold line 40 and includes a foldable gusset panel 42 which interconnects along fold lines 44 and 46, respectively, the lower end of the end closure panel 38 to the base panel 12. Gusset panel 42 is detached from the base panel 12 along cut line 48 and can fold inwardly by virtue of intermediate fold line 50 to adopt a flat form on top of the base panel 12 when the end closure panel 38 is closed.

A second lower end closure panel 52 is hinged to second lower side wall panel 22 along a fold line 54 and includes a foldable gusset panel 56 which interconnects along fold lines 58 and 60, respectively, the lower end of the end closure panel 52 to the base panel 24.

Gusset panel 56 is detached from the base panel 24 along cut line 62 and can fold inwardly by virtue of intermediate fold line 64 to adopt a flat form on top of the base panel 24 when the end closure panel 52 is closed. This end closure panel set also includes a top end closure panel 66 which is hinged to the top panel 18 along longitudinal fold line 68. The top end closure panel is hinged to upper retention panels 70 and 72 along fold lines 74 and 76, respectively. Adjacent the opposite ends of the top end closure panel 66 the retention panels 70 and 72 include fold lines 78 and 80 which together with fold lines 74 and 76 respectively form a pair of triangular gusset panels G1 and G2 at each of the opposite longitudinal ends of the top end closure panel.

The upper retention panels 70 and 72 are formed with retaining tabs T1 and T2 which project beyond the free longitudinal edge of top end closure panel 66. The upper end retention panels are integrally hinged to upper side wall panels 16 and 20 along fold lines 82 and 84 respectively.

The lower end closure panel 38 is hinged to upper retention panel 70 along a fold line 86 and panel 70 includes fold line 88 which, together with fold line 86, defines a gusset panel G3 between lower end closure panel 38 and upper retention panel 70. Likewise, lower end closure panel 52 is hinged to upper retention panel 72 along a fold line 90 and panel 72 includes fold line 92 which, together with fold line 90, defines a gusset panel G4.

The opposite set of end closure panels hinged along the opposite longitudinal edges of the main wall panels of the blank are identical to the set of end closure panels described above and accordingly like parts are designated like reference numerals with the addition of the suffix "'".

In order to form the completed carton, the blank is wrapped about a group of pre-arranged articles such as bottles 'B' and once the base panels 12 and 24 have been brought into overlapping alignment and locked together the ends of the carton are ready to be closed. However, during the application process the top end closure panels 66, 66' are folded out of the plane of the blank about fold lines 68, 68' respectively. Thus, because of the folded connections between all the panels in each of the end closure panel sets the end closure panels along each longitudinal edge of the blank fold together in like manner to that of top end closure panels 66 and 66'. Immediately thereafter the blank is folded along transverse fold line 30 and 32 to bring the side walls (and associated base panels) into a perpendicular position relative to the top wall panel 18. This folding process automatically causes the gusset panels G1–G4 to fold relative to the adjacent panels so that the upper retention panels are folded internally of the sleeve being formed such that the retention tabs T1 and T2 are tucked between the necks of endmost bottles B1 and B2 and the adjacent upper side wall panels 16 and 20, respectively, of the carton. The similar tabs T1' and T2' are likewise folded. Folding is completed when the top end closure panels are substantially perpendicular to the top panel 18 and the lower end closure panel pairs 38, 52 and 38', 52' meet across the ends of the carton as shown, at one carton end in FIG. 2 of the drawings. Thus one end of the carton is virtually closed by one set of end closure panels and the other end of the carton is virtually closed by the opposed set of end closure panels although the contents of the carton, bottles B, can be viewed to some extent through the opening defined between the upper edges of the lower end closure panels and the lower edge of the upper end closure panel.

During folding of the side wall panels the lower gusset panels 42 and 56 are tucked into the ends of the carton by folding about fold lines 44, 46, 50 and 58, 60, 64 respectively so that the lower gusset panels are placed into overlapping relationship with the base panels 12 and 24 respectively.

The carton is complete by folding the base panels 12 and 24 relative to the side wall panels into overlapping relationship and then interengaging the locking tabs and locking apertures as is well known in the art.

If desired, the ends of the carton may be completely closed in a modified arrangement of this embodiment in which the lower end closure panels are formed so that they extend upwardly to a greater extent than do those described above and/or similarly the top end closure panel can be made broader to meet or indeed overlap the uppermost edges of the lower end closure panels.

I claim:

1. A carton of the wraparound type for bottles which carton comprises top and bottom panels connected together by spaced side wall panels thereby forming a tubular structure, and a set of end panels at each end of the tubular structure at least partially to close the ends of the carton, each said set comprising a pair of lower end closure panels hinged to respective ones of the side wall panels and folded so as to extend across that end of the tubular structure towards one another to close a lower part of said end and an upper end panel hinged to the top panel of the carton and folded downwardly at least partially to complete the closure of the upper part of said end, said upper end panel and each of said lower end closure panels are connected by a retaining panel which extends sufficiently internally of the tubular structure to permit it to be tucked between the endmost articles and the respective side wall panels adjacent thereto so as to maintain said upper end panel and said lower end closure panels in position.

2. A carton according to claim 1 wherein said upper end closure panel and each of said lower end closure panels are connected by at least one gusset panel.

3. A carton according to claim 1 wherein each of said lower end closure panels is connected to a bottom panel by foldable gusset panels adapted to provide a two-ply element at each lower corner of said carton.

* * * * *